United States Patent [19]

Serras-Paulet

[11] 4,203,013

[45] May 13, 1980

[54] ALPHANUMERIC CONTROL KEYBOARD WITH DEPRESSIBLE KEYS FOR ELECTRIC OR ELECTRONIC MACHINES

[76] Inventor: Edouard Serras-Paulet, Casa Nostra - Pech des Treilles, 82240 Puylaroque, France

[21] Appl. No.: 874,553

[22] Filed: Feb. 1, 1978

Related U.S. Application Data

[63] Continuation-in-part of Ser. No. 735,769, Oct. 26, 1976, abandoned.

[30] Foreign Application Priority Data

Jun. 22, 1977 [FR] France ..... 77 19170

[51] Int. Cl.[2] ..... H01H 13/70; G06C 7/02; G08C 1/00; B41J 5/08

[52] U.S. Cl. ..... 200/5 A; 200/302; 235/145 R; 335/206; 340/365 L

[58] Field of Search ..... 200/5 R, 5 A, 5 E, 5 EA, 200/5 EB, 16 A, 67 F, 159 R, 159 A, 159 B, 239–243, 302, 318, 328, 340; 335/205, 206, 207; 340/365 L; 235/145 R

[56] References Cited

U.S. PATENT DOCUMENTS

| | | | |
|---|---|---|---|
| 3,165,624 | 1/1965 | Jones, Jr. | 335/205 |
| 3,175,060 | 3/1965 | Crissinger et al. | 335/205 |
| 3,448,419 | 6/1969 | Myatt | 335/207 X |
| 3,478,857 | 11/1969 | Linker | 200/302 X |
| 3,588,766 | 6/1971 | Baermann | 178/17 C X |
| 3,639,123 | 9/1972 | Pedersen | 340/365 L X |
| 3,639,869 | 2/1972 | Pedersen | 335/207 |
| 3,641,286 | 2/1972 | Berezowski | 200/16 A X |
| 3,736,397 | 5/1973 | Pedersen | 340/365 L X |
| 3,761,016 | 9/1973 | Pedersen | 335/206 X |
| 3,768,095 | 10/1973 | Lins et al. | 340/365 L |
| 3,879,602 | 4/1975 | Walker | 335/205 X |
| 3,900,813 | 8/1975 | Masuda et al. | 338/32 R |
| 3,916,360 | 10/1975 | Pedersen et al. | 200/159 B X |

OTHER PUBLICATIONS

Taisaku Wada, *Japan Electronic Engineering*, "Pulse Key: A Contactless Switch Based on the Electromagnetic Coupling Effect", Jan. 1971, pp. 39–44 and 112.

M. Sulich et al., *IBM Tech. Disc. Bull.*, "Magnetic Key Mechanism", vol. 15, No. 7, Dec. 1972, pp. 2261, 2262.

McDowell et al., "Magnetoresistive Contact-Less Switch", IBM Tech. Disc. Bull., vol. 12, No. 3, Aug. 1969, pp. 436, 437.

Ludeman, C. P., "Hall Effect Keyboard Including Magnetic Keeper", IBM Tech. Disc. Bull., vol. 14, No. 10, Mar. 1972, pp. 2924, 2925.

Dirks, W. G., "Keyboard", IBM Tech. Disc. Bull., vol. 12, No. 7, Dec. 1969, p. 982.

Strnad, R. J., "Keyboard Switching Mechanism"; IBM Tech. Disc. Bull., vol. 13, No. 4, Sep. 1970, p. 898.

*Primary Examiner*—James R. Scott

*Attorney, Agent, or Firm*—Haseltine, Lake & Waters

[57] ABSTRACT

A control keyboard for electric or electronic machines, with a first plate having a number of apertures, and keys mounted through these apertures; the keys have flanges of magnetic material on their lower portions to prevent the keys from slipping out. A second plate underneath the first plate has contacts cooperating with the key flanges. The first plate has an upper metal plate and a lower magnetic layer. The keys are movable between a first position when flanges are applied to the lower magnetic layer, apart from the contacts, and a second position where the flanges touch the contacts. The lower magnetic layer and the flanges return the keys from the second to the first position by magnetic attraction. An upper grid mounts the keyboard in a casing, with the upper metal plate between the lower magnetic layer and the upper grid. Each key has a body and a cap. A sheet of fluid-tight and resilient material may be clamped between the upper grid and the upper metal plate.

12 Claims, 7 Drawing Figures

ALPHANUMERIC CONTROL KEYBOARD WITH DEPRESSIBLE KEYS FOR ELECTRIC OR ELECTRONIC MACHINES

CROSS REFERENCE TO RELATED APPLICATIONS

The present invention is a Continuation-in-Part of U.S. parent application Ser. No. 735 769 filed on Oct. 26, 1976 now abandoned.

BACKGROUND OF THE INVENTION

The present invention relates generally to an alphanumeric control keyboard with depressible keys for electric or electronic machines, of the type comprising a plurality of keys which are mounted through the apertures of the keyboard and are urged by return means to their initial position in which the keys protrude from the apparent or external face of the keyboard. The invention also relates to the electric or electronic machines equipped with such a keyboard.

Keyboards of this type are well-known at the present time and used in all kinds of machines such as computer control desks or consoles, typewriters, hand-held or pocket calculators, all machines that include depressible-key control means.

Various problems arise when mounting and using such keyboards. Indeed, the keys are usually returned to their off or inactive position by springs or equivalent elastic return means which suffer from a certain number of important drawbacks due to the fatigue phenomenon which appears in the return spring (loss of stiffness, marked settling or breakage), the sensitivity to corrosion, the technical and climatic surrounding, the difficulty of mounting each key associated with an independent return spring, the high manufacturing costs, and so forth.

Moreover, the various keyboard elements must be assembled by the machine manufacturer owing to the close mechanical association of the control keys with, on the one hand, the corresponding contact elements of the electric or electronic circuits of the machines and, on the other hand, with their mechanical return means.

The invention has precisely for its object the avoidance of such drawbacks of the known control keyboards.

The invention also has for its purpose a control keyboard which can be made with its keys independently of the machine for which it is intended and which can thereafter be simply mounted on the machine.

SUMMARY OF THE INVENTION

The invention therefore provides an alphanumeric control keyboard with depressible keys for electric or electronic machines, comprising a plurality of keys mounted through apertures in the keyboard and urged by return means to their intitial position protruding from the apparent or external face of the keyboard, and provided with flanges or shoulders on their lower portions preventing them from completely slipping out from the apertures. The keyboard consists of a unitary assembly constituted on the one hand by a plate provided with a plurality of apertures and on the other hand by the keys whose flanges or shoulders co-operate with the plate to form magnetic return means retaining the keys applied on the plate in their aforesaid initial position.

The keyboard thus obtained according to the invention constitutes a unitary assembly which can be made independently of the electric or electronic machine concerned and which can be supplied as such to the machine manufacturer who will only have to mount the same on the machine as a single unit. On the other hand, easy manufacture and mounting make the keyboard of the invention much less expensive than the corresponding keyboards of known types.

The invention also relates to the electric or electronic machines provided with depressible-key alphanumeric control means, characterized in that they include a keyboard according to the invention.

The invention will be better understood and other purposes, features and advantages of the latter will appear more clearly from the following explanatory description, with reference to the appended diagrammatic drawings given solely by way of example illustrating two forms of embodiment of the invention and wherein: Brief Description of the Drawings FIG. 1 is a top view of a small-size, hand-held calculator provided with a control keyboard according to the invention;

DESCRIPTION OF THE PREFERRED EMBODIMENTS

Figure 1:
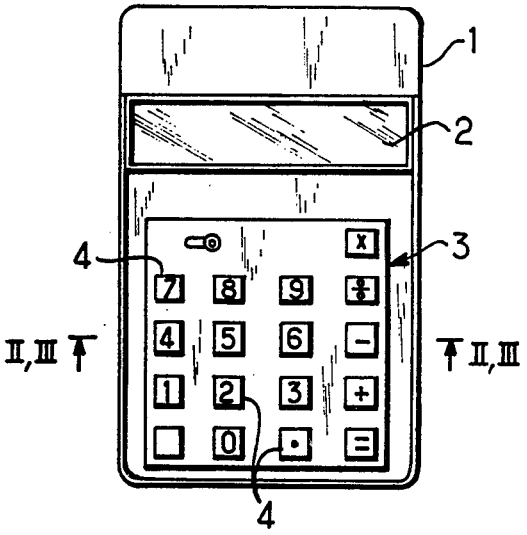

Diagrammatically illustrated in FIG. 1 is a small-size electronic calculator, or hand-held calculator, capable of performing a certain number of simple operations such as additions, substractions, multiplications, divisions, and percentages. The electronic calculator comprises a casing 1, usually of plastics, the upper face of which is provided with a window 2 for displaying the selected numbers and the results of the operations, and a control keyboard 3 including a certain number of depressible keys 4 whose upper face, e.g. imprinted, indicates the corresponding figure or operation.

Figure 2:
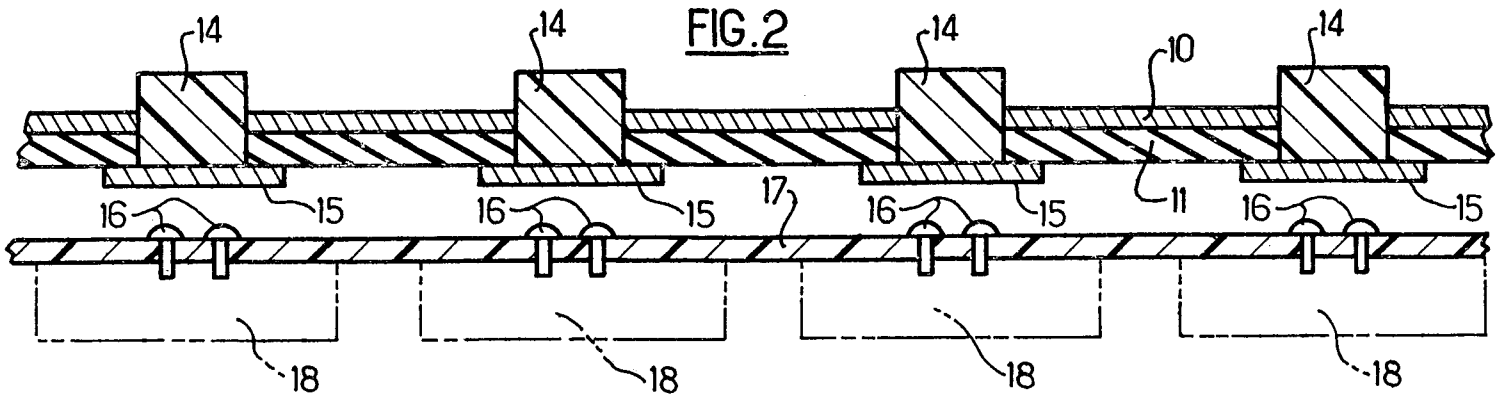
FIGS. 2 and 3 are sectional views upon II—II and III—III, respectively, of FIG. 1, illustrating two different forms of embodiment of a keyboard according to the invention.
Figure 3:
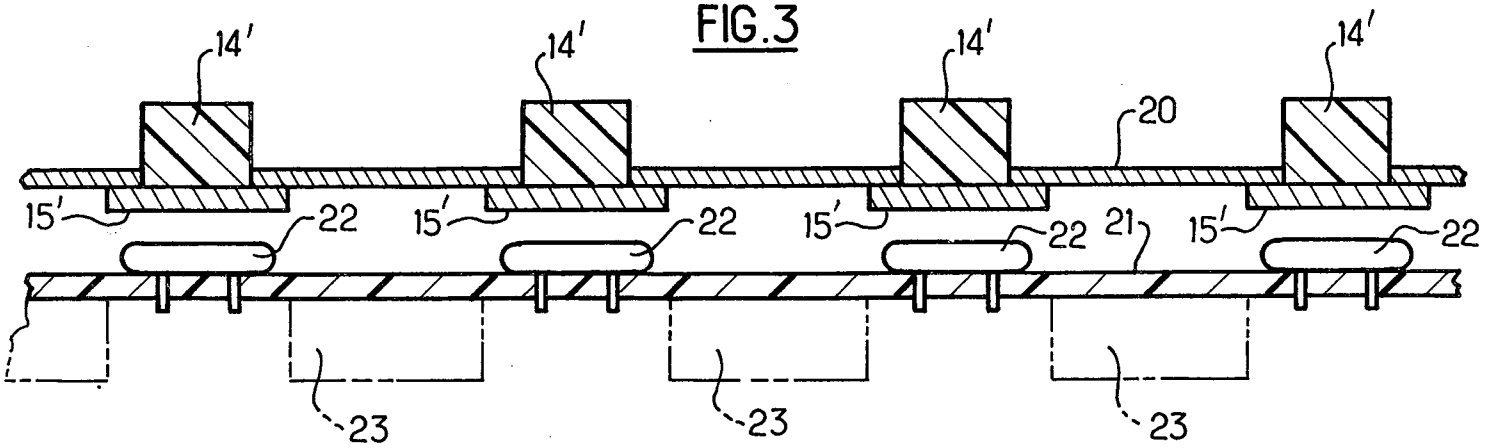

The sectional views in FIGS. 2 and 3 allow the structure of the keyboard of the invention according to two different forms of embodiment to be better understood.

In FIG. 2, the keyboard according to the invention is essentially constituted by a plate 10 of magnetic or ferromagnetic material, e.g. iron, the lower face of which is covered with a layer 11 of a material exhibiting permanent magnetisation, e.g. magnetic rubber such as the one available on the market under the denomination "Ferriflex". A thin sheet of such magnetic rubber is therefore secured, e.g. adhesively fastened, to the lower face of the iron plate 10, and then apertures of any shape, e.g. circular, rectangular, square or oval, are made through the assembly 10, 11, e.g. by means of a punch, die or like tool, for the control keys 4 to be passed therethrough. The keys comprise a shank or body 14, the shapes and dimensions of which substantially correspond to those of the said apertures and the lower portion of which ends with a flange or shoulder 15 whose transverse dimensions are greater than those of the aperture in which the key is placed. The flanges 15 are made at least partially from a material apt to be magnetically attracted by the layer 11 of magnetic material, so as to adhere to the latter when no external action is exerted on the corresponding keys. Furthermore, the material of the flange 15 may be a good electric conductor in order that, when the corresponding key is depressed an electric connection be ensured between two contact elements 16 slightly projecting from the upper face of a printed-circuit plate 17 whose other face may carry electric or electronic circuit elements 18 such as semi-conductors, resistors, and so forth.

In a second form of embodiment of the invention illustrated in FIG. 3, the keyboard is constituted essentially by a plate 20 of magnetic or ferromagnetic material provided with a plurality of apertures obtained by means of a punch, die or like tool, and with a plurality of control keys including a shank or body 14' passing through the corresponding aperture, and an abutment flange 15' constituted by a permanent magnet, so that each key subjected to no external action is in the position shown in FIG. 3.

The keyboard shown in FIG. 3 is intended, in particular, to be placed above a printed-circuit plate 21 whose upper surface facing the plate 20 supports Hall-effect semi-conductors 22. When the permanent magnet forming the flange 15' of a key is moved from a semi-conductor 22, as illustrated in FIG. 3, this semi-conductor element has practically infinite impedance. By contrast, when the control key is depressed and the magnet 15' comes substantially into contact with the semi-conductor 22, the impedance of the latter is practically reduced to zero.

As in the foregoing case, the opposite face of the printed-circuit plate 21 may carry electric or electronic circuit elements 23, e.g. semi-conductors, resistors, capacitors, and so forth.

A keyboard according to the invention is therefore particularly easy to make: it is sufficient to provide, e.g. by means of a punch, die or like tool, a series of apertures in a plate which is a simple metal plate in the form of embodiment shown in FIG. 3, or which is a metal plate lined with a magnetic rubber layer as in the form of embodiment illustrated in FIG. 2, and then to introduce the control keys into the corresponding apertures. The keys remain permanently applied on or in abuting relationship to the plate 10, 11 or 20 owing to the magnetic attraction between the latter and the flanges 15 or 15' of the keys.

Also the mounting of such a keyboard on an electronic machine or a control desk, console or panel is quite simple. Indeed, it is sufficient to place the keyboard according to the invention above the already mounted printed-circuit plates 17, 21 in such a manner as to provide a suitable air-gap therebetween (usually between approximately 0.8 and 2 mm) and to secure the keyboard in the desired position. In the case of a hand-held or pocket calculator, a control desk, console or panel or other machines or a like type, the metal plate of the keyboard may form the cover, cap or lid of the machine or of the desk, console or panel, or may from an integral part of the cover, cap or lid, of a particular shape suitable for the machine and solving the problems of industrial esthetics, owing to the use of magnetic rubber, which is a flexible material to which particular configurations can be imparted.

It is therefore seen that the present invention removes all the drawbacks inherent in the keyboards of the prior art, which were due to the use of elastic return means such as springs for the control keys.

A keyboard according to the invention can be used in all cases where it is necessary to transcribe alphanumeric data, more specifically as a keyboard for typewriters, accounting machines, cash registors, peripheral computer elements, distributors, supervision and control equipments, and so forth.

The contact elements 16 and the flanges 15 of the lower portions of the keys shown in FIG. 2 may have any desired shapes ensuring a correct connection between the contact elements 16 despite slight level differences therebetween. Furthermore, plate 10 on the internal face of which the layer 11 of magnetic rubber or the like is adhesively secured may be of plastics if desired or of ferromagnetic material as described above. In this last case, the magnetic field produced by the magnetic rubber is annulled on the side of the external face of the keyboard on the plate 10, whereas the depth of this magnetic field is increased and even sometimes doubled on the other side, i.e. in the airgap between the layer 11 and the printed-circuit plate 17.

Figure 4:
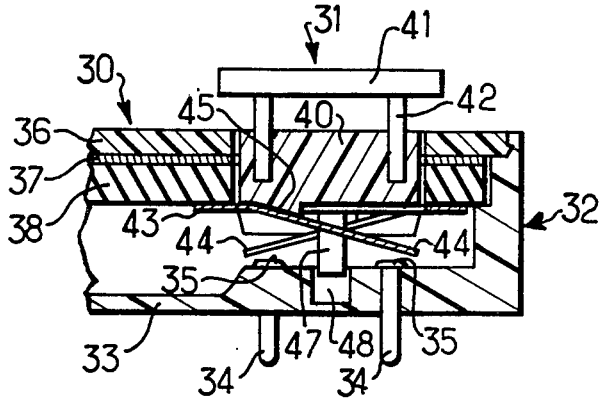
FIG. 4 is a diagrammatic sectional view of part of a third form of embodiment of a keyboard according to the invention.

In FIG. 4 there is therefore diagrammatically shown a sectional view of a portion of another form of embodiment of a keyboard according to the invention.

The keyboard 30 is in the form of a flat plate provided with several apertures in which are arranged keys 31, only one of which is shown in the drawings. The keyboard is mounted on a casing 32 so as to close its upper side. The lower side of casing 32 is constituted by a plate 33 of insulating material carrying the contact elements 34 associated with each key 31. In this form of embodiment the elements 34 are simple, electrically conductive connecting pins passing through the plate 33 and provided within the casing 32 with a head 35.

The keyboard plate 30 comprises an upper mounting plate or grid 36 made for example of insulating material, an intermediate metal plate 37 forming the external screen or shield of the keyboard, and a magnetic elastomer or magnetically charged plate or sheet 38 forming a permanent magnet. It is understood that the intermediate plate 37 suppresses the magnetic field of the elastomer sheet 38 on the upper face of the plate 30.

Figure 6:
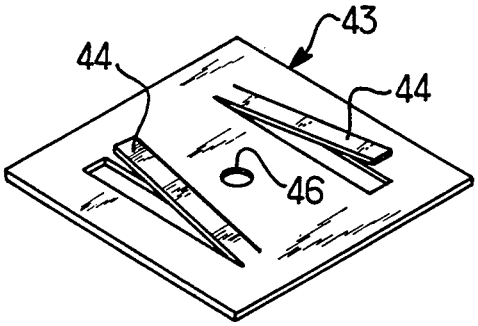
FIG. 6 is a perspective view of the metal plate carried by the body of each key of FIGS. 4 and 5.

The key 31 comprises a body 40 of insulating material on which a head or cap 41 is removably mounted, for example, by means of two legs 42 engaged into corresponding holes of the upper face of the body 40, and the body 40 also carries on its lower face a metal plate 43 shown in detail in FIG. 6 and which also serves as a means for the magnetic return of the key 31 to its rest position shown in the drawings, and the contact means 44 of the key intended to co-operate with the heads 35 of the pins 34.

The plate 43 is made of an electrically conductive material and is adapted to be magnetically attracted by the magnetic elastomer layer 38. It is secured in an appropriate manner on the lower face of body 40, as by set-in, clipping or resilient lock-in engagement.

Figure 5:
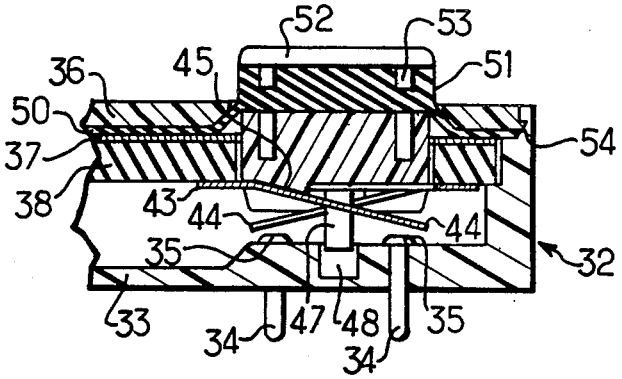
FIG. 5 is a diagrammatic sectional view of part of fourth form of embodiment of a keyboard according to the invention.

The plate comprises two cut-out tongues or lips 44 bent or directed obliquely with respect to the plane of the plate 43, so as to each extend towards the head 35 of an associated element 34, as seen in FIGS. 4 and 5. The lips 44 are supported along a portion of their length and in the vicinity of their junction with the rest of the plate 43, by inclined surfaces 45 provided on the lower face of the body 40.

It will be noted that in the form of embodiment illustrated the lips 44 are parallel with one another but directed in opposite directions.

The plate 43 is also provided with a substantially central hole 46 through which passes a guide pin provided substantially at the center of the lower face of the body 40 and directed perpendicularly to the said lower face. The pin 47 is adapted to enter a corresponding recess or hole 48 of the plate 33 carrying the contact elements 34. The hole 48 is advantageously blind and serves to limit the inward or depressing travel of the key 31.

The device just described operates as follows. When no action is exerted on the key 31, it is in the position of rest represented in FIG. 4, the plate 43 being applied on the magnetic elastomer layer 38 as a result of magnetic attraction. In that position the guide pin 47 can already slightly enter the hole 48 of the plate 33 of the casing 32. When the key 31 is depressed with a force greater than the force of magnetic attraction between the elastomer layer 38 and the plate 43, the key 31 moves into the keyboard and the lips 44 are brought into contact with the heads 35 of the contact elements 34 and slide on the heads 35 as the depressing of the key proceeds.

It will be observed that the force of magnetic attraction between the plate 43 and the elastomer layer 38 decreases as the key is depressed, so that partial depressing of the key 31 is thus made impossible. The depressing of the key is limited for example by the guide pin 47 abutting against the bottom of the hole 48 of the plate 33, or when the lower surface of casing 40 meets the upper face of plate 33.

When operator pressure on the key 31 is released, it rises back to its initial position under the action of magnetic attraction between the plate 43 and the elastomer layer 48. During this return motion, the lips 44 again slide on the heads 35 of contact elements 34.

It is of course understood that when the key is depressed the lips 44 interconnect the two associated key elements 34.

The form of embodiment of FIG. 5 relates to a keyboard which is made fluid-tight due to the use of a sheet 50 of flexible and tight material, such as rubber, interposed in the keyboard plate between the mounting grid or plate 36 and the metal shield plate 37 covering the magnetic elastomer layer 38. As appears in FIG. 5, the rubber sheet 50 may include in the region of each key a thicker portion 51 covering the upper face of the key body 40 and allowing for the mounting of the head or cap 52 of the key by means of two legs 53 introduced into corresponding blind holes of the thicker portion 51 of the sheet 50.

The sheet 50, in order to ensure reliable fluid-tightness, is clamped by the mounting grid or plate 36 in a resilient lock-in engagement slot 54 provided in the upper edges of the casing 32. In order not to interfere with the depressing of the keys, the edges of the orifices formed in the mounting grid or plate 36 for the passage of the keys are inwardly offset, as shown in FIG. 5, to provide a space allowing for free movement of the portion of the sheet 50 immediately surrounding its thicker portion 51.

The other keyboard elements illustrated in FIG. 5 are identical with and operate in the same manner as those of the keyboard of FIG. 4.

Figure 7:
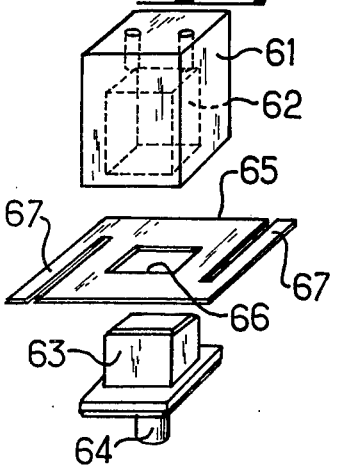
FIG. 7 is a partial diagrammatic perspective view of another form of embodiment of a key according to the invention.

In FIG. 7 there is shown a partial diagrammatic view of another form of embodiment of the key illustrated in FIGS. 4 and 5. The body 61 of the key comprises in its lower portion a central cavity 62 of polygonal, e.g. square, section, intended to be closed by a plug 63 provided at its lower end with a guide pin 64.

A metal plate 65 is provided with a central hole 66, also of square section, through which the plug 63 tightly engaged into or adhesively fastened in the cavity 62 passes, so that the plate 65 is thus held between the body of the key 61 and the plug 63. The plate 65 is provided with two contact lips or tongues 67 formed at its ends and normally bent or curved downward. The lips 67 are formed by cuts made near the edge of the plate 65 which constitutes the magnetic means of return of the key to its rest position. They form self-cleaning contacts with the contact heads 35, as seen in FIGS. 4 and 5.

On the other hand, when the key is in its rest position, the plate 65 is applied by magnetic attraction on the magnetic elastomer layer 38, and so are the lips 67, which are thus insensitive to vibration, in contradistinction to the lips 44 of FIGS. 4 and 5.

The resiliency of the contact tongues 44 or 67 is very low and permits mainly the contact tongues 44 or 67 to be self-cleaning contacts (i.e.to slide on contact heads 35). Of course, this resiliency can make easier the return of the key to its rest position, but it is not necessary and the keys can return to the rest position only by magnetic attraction between the flange 43 and the magnetic layer 38.

Regarding the lips 67, they are normally bent as lips 44 shown in FIG. 6. But when the key is in its rest position, the lips 67 are attracted by the magnetic elastomer 38 and applied thereon and they are straight in this position as shown in FIG. 7. For this reason, lips 67 are less sensitive to vibrations than lips 44 when they are in their rest position.

Of course the invention is by no means limited to the forms of embodiment described and illustrated which have been given by way of example only. In particular it comprises all means constituting technical equivalents to the means described as well as their combinations should the latter be carried out according to its gist and used within the scope of the following claims.

What is claimed is:

1. A control keyboard, comprising a first plate having a plurality of apertures, a plurality of keys mounted through said apertures, said keys having flanges of magnetic material on their lower portions for preventing the keys from completely slipping out of said apertures, a second plate arranged under said first plate with a relatively small air gap therebetween and carrying contact means cooperating with said flanges of the keys, said first plate comprising a lower magnetic layer and an upper metal plate forming a magnetic shield for the keyboard, said keys being movable between a first positions in which the flanges are applied onto said lower magnetic layer and kept apart from said contact means and a second position wherein said flanges are applied onto said contact means, said lower magnetic layer and said flanges forming magnetic return means for returning said keys from their second positions to their first positions by magnetic attraction.

2. A keyboard according to claim 1, comprising an upper grid for mounting the keyboard in a casing, wherein said upper metal plate is interposed between said lower magnetic layer and said upper grid.

3. A keyboard according to claim 2, wherein each of said keys comprises a body and a cap removably mounted on an upper portion of said body, said keyboard further comprising a sheet of fluid-tight and resilient material clamped between said upper grid and said upper metal plate and extending between said cap and said body of each key for ensuring fluid-tightness of the keyboard.

4. A keyboard according to claim 1, wherein said second plate forms a casing having an upper face which is closed by said first plate.

5. A keyboard according to claim 1, wherein said lower magnetic layer is made of a magnetic elastomer.

6. A keyboard according to claim 1, wherein said flanges of each key are made of a transverse metal plate secured on the lower portion of said key and comprise two tongues extending obliquely with respect to said transverse plate, said tongues being adapted to be brought in contact with said contact means when said key is in its second position.

7. A keyboard according to claim 6, wherein the lower face of said keys comprises inclined surfaces along which said tongues are applied.

8. A keyboard according to claim 1, wherein said second plate is a printed circuit board.

9. A keyboard according to claim 1, wherein the lower face of each key has an axial guide pin extending a corresponding recess of said second plate.

10. Alphanumeric control keyboard with depressible keys for electric machines comprising a plurality of keys mounted through apertures in the keyboard and provided with magnetic flanges, said keys in their initial position protruding from an external face of the keyboard and being provided with flanges on lower portions of said keys for preventing the latter from completely slipping out from said apertures, said keyboard consisting of a unitary assembly comprising a plate provided with a plurality of said apertures and said keys, each of which is made of a single piece and the magnetic flanges of which co-operate with said plate retaining the keys applied on said plate when said keys are in their aforesaid initial position, each key comprising a body of electrically insulating material passing through one of said apertures of said plate, on the lower surface of which is secured a transverse metal plate which at the same time forms said flange of said key and contacts said key with conductive elements carried by a plate of insulating material arranged under the plate of the keyboard with a relatively small air-gap therebetween, said keyboard plate comprising a lower magnetic elastomer layer formimg with said transverse metal plate of each key magnetic return means, and an upper metal plate forming a magnetic screen or shield for the keyboard, so that there is no magnetic field on the external face of the keyboard.

11. A keyboard according to claim 10, wherein said shield plate is interposed between said mangetic elastomer layer and a grid for mounting the keyboard on a casing.

12. Alphanumeric control keyboard with depressible keys for electric machines comprising a plurality of keys mounted through apertures in the keyboard and provided with magnetic flanges, said keys in their initial position protruding from an external face of the keyboard and being provided with flanges on lower portions of said keys for preventing the latter from completely slipping out from said apertures, said keyboard consisting of a unitary assembly comprising a plate provided with a plurality of said apertures and said keys, each of which is made of a single piece and the magnetic flanges of which co-operate with said plate retaining the keys applied on said plate when said keys are in their aforesaid initial position, each key comprising a body of electrically insulating material passing through one of said apertures of said plate, on the lower surface of which is secured a transverse metal plate which at the same time forms said flange of said key and contacts said key with conductive elements carried by a plate of insulating material arranged under the plate of the keyboard with a relatively small air-gap therebetween, a cap mounted removably on the upper portion of said key, an upper face of the keyboard comprising a sheet of fluid-tight and resilient material sealingly extending between the upper portion of the body of each key and the associated cap so as to ensure the fluid-tightness of the keyboard, said sheet of fluid-tight material being held in place by said mounting grid by being clamped between the latter and said shield plate.

* * * * *